US008181696B2

(12) United States Patent
Rassmus

(10) Patent No.: US 8,181,696 B2
(45) Date of Patent: May 22, 2012

(54) PLATE HEAT EXCHANGER INCLUDING STRENGTHENING PLATES PROVIDED OUTSIDE OF THE OUTERMOST HEAT EXCHANGER PLATES

(75) Inventor: Jens Erik Johannes Rassmus, Malmo (SE)

(73) Assignee: Alfa Laval Corporate AB (SE)

( * ) Notice: Subject to any disclaimer, the term of this patent is extended or adjusted under 35 U.S.C. 154(b) by 873 days.

(21) Appl. No.: 12/281,505

(22) PCT Filed: Mar. 29, 2007

(86) PCT No.: PCT/SE2007/050198
§ 371 (c)(1),
(2), (4) Date: Sep. 3, 2008

(87) PCT Pub. No.: WO2007/114779
PCT Pub. Date: Oct. 11, 2007

(65) Prior Publication Data

US 2009/0008072 A1 Jan. 8, 2009

(30) Foreign Application Priority Data

Apr. 4, 2006 (SE) ..... 0600758

(51) Int. Cl.
*F28F 3/08* (2006.01)

(52) U.S. Cl. ..... 165/167; 165/906; 165/916

(58) Field of Classification Search ..... 165/167, 165/906, 916
See application file for complete search history.

(56) References Cited

U.S. PATENT DOCUMENTS 3,939,908 A * 2/1976 Chartet ..... 165/149
4,987,955 A 1/1991 Bergqvist et al.
5,307,869 A 5/1994 Blomgren
(Continued)

FOREIGN PATENT DOCUMENTS

EP 0347961 12/1989
(Continued)

OTHER PUBLICATIONS

Russian Federation Notice of Allowance for Application No. 2008143407, dated Oct. 6, 2010. 11 pages.
(Continued)

*Primary Examiner* — Leonard R Leo
(74) *Attorney, Agent, or Firm* — Fish & Richardson P.C.

(57) ABSTRACT

The invention relates to a plate heat exchanger including a plurality of plates. The plates extend in parallel to a main extension plane and include several heat exchanger plates and a strengthening plate (2). The heat exchanger plates are provided beside each other and form a plate package with first plate interspaces and second plate interspaces. Each heat exchanger plate has four portholes forming ports (8) through the plate package. The heat exchanger plates include an outermost heat exchanger plate at one side of the plate package and an outermost heat exchanger plate at an opposite side of the plate package. Two of the plate interspaces in the plate package form a respective outermost plate interspace at a respective side of the plate package, which are delimited outwardly by a respective one of the outermost heat exchanger plates. The strengthening plates are provided outside one of the first heat exchanger plates. The strengthening plates (2) have a main zone (20), which extends in parallel with the extension plane and which includes a strengthening pattern (21), which is provided in the proximity of two of the ports (8) and includes at least one depression (22) extending outwardly from the heat exchanger plates.

14 Claims, 3 Drawing Sheets

U.S. PATENT DOCUMENTS

| | | | | | |
|---|---|---|---|---|---|
| 5,492,172 | A | * | 2/1996 | Laveran et al. | 165/906 |
| 5,645,126 | A | * | 7/1997 | Nishishita et al. | 165/906 |
| 5,964,280 | A | | 10/1999 | Wehrmann et al. | |
| 5,988,269 | A | * | 11/1999 | Karlsson et al. | 165/167 |
| 6,006,430 | A | * | 12/1999 | Fukuoka et al. | 29/890.03 |
| 2002/0134535 | A1 | | 9/2002 | Nozaki et al. | |
| 2003/0121650 | A1 | * | 7/2003 | Strahle et al. | 165/906 |

FOREIGN PATENT DOCUMENTS

| | | | |
|---|---|---|---|
| EP | 0622600 | | 11/1994 |
| FR | 2735855 | | 12/1996 |
| JP | 1503558 | C | 11/1989 |
| JP | 5507787 | A | 11/1993 |
| JP | 9273886 | A | 10/1997 |
| SE | 504868 | | 5/1997 |
| SU | 276091 | | 11/1969 |
| SU | 1636680 | A1 | 3/1991 |
| WO | WO8809473 | A1 | 12/1988 |
| WO | WO9117404 | A1 | 11/1991 |
| WO | 0148433 | | 7/2001 |

OTHER PUBLICATIONS

Office action dated Sep. 20, 2006 in corresponding Swedish application 0600758-7, by Annette Riedel (and English translation) (total of 8 pages).

Applicant's response dated Jan. 15, 2007, by Stefan Berglund (and English translation) to the Swedish office action dated Sep. 20, 2006 (total of 9 pages).

Information about alleged prior art device SWEP G28—"solid stainless steel plate heat exchanger," allegedly available in Sweden, date uncertain (total of 4 pages).

Information about Swedish company Landstryck AB, alleged to have become bankrupt in 2002 (total of 3 pages).

Information about alleged prior art device "Vaillant," allegedly available in Sweden in 2005 (total of 5 pages).

Int'l Search Report.

Int'l Preliminary Report on Patentability.

Japanese Office Action for Application No. 2009-504158 dated Aug. 10, 2011 in English (2 pages).

* cited by examiner

PLATE HEAT EXCHANGER INCLUDING STRENGTHENING PLATES PROVIDED OUTSIDE OF THE OUTERMOST HEAT EXCHANGER PLATES

THE BACKGROUND OF THE INVENTION AND PRIOR ART

The invention refers to a plate heat exchanger comprising a plate package with a plurality of heat exchanger plates, each of which extends in parallel with a main extension plane, and at least one strengthening plate, wherein the heat exchanger plates are provided beside each other and form a plate package with first plate interspaces for a first medium and second plate interspaces for a second medium, wherein each of the heat exchanger plates has four portholes which form ports extending through the plate package, wherein the heat exchanger plates include an outermost heat exchanger plate at one side of the plate package and an outermost heat exchanger plate at an opposite side of the plate package, wherein two of the plate interspaces in the plate package form a respective outermost plate interspace at a respective side of the plate package, which are delimited outwardly by a respective one of the outermost heat exchanger plates, for example see U.S. Pat. No. 4,987,955 A.

In many applications for permanently joined, for instance brazed, plate heat exchangers, a high strength is required. This is important when the working pressure of one or both of the media conveyed through the plate heat exchanger is high or when the working pressure for one or both of the media various over time. Plate heat exchangers are pressure tested before delivery. It is desirable to achieve such a strength and rigidity of the plate heat exchanger that the plastic deformation in connection with the pressure testing is as small as possible.

In order to meet requirements of higher strength it is known to use thicker end or strengthening plates, i.e. the two plates located at the outermost position in the plate package. These strengthening plates may also be designated as adapter plates or frame and pressure plates. It is also known to use sheets, washers or thick plane plates as strengthening plates. Such sheets, washers or thick plane plates may also be provided outside the frame and/or pressure plates. A disadvantage of such additional plates, washers or the like is that the manufacturing becomes more complicated since more components have to be fixed when the plate heat exchanger is produced, for instance when it is brazed.

Another disadvantage of thicker strengthening plates with more material is that the thermal "slowness" increases for this strengthening plates. Due to this higher thermal slowness of the strengthening plates, a reduced thermal fatigue performance of the plate heat exchanger is obtained, in particular in the heat exchanger plates which are provided most adjacent inside the strengthening plates. Since the heat exchanger plates are manufactured of a thinner material, they will more rapidly be adapted to the temperature of the media, which results in an undesired temperature difference between the heat exchanger plates and the strengthening plates, and thus to thermally dependent stresses.

Furthermore, thicker strengthening plates result in the disadvantage that the consumption of material becomes larger and thus the costs for the plate heat exchanger increase.

U.S. Pat. No. 4,987,955 discloses a plate heat exchanger comprising a plurality of plates extending in parallel with a main extension plane. The plates comprise a plurality of heat exchanger plates and at least one strengthening plate. The heat exchanger plates are provided beside each other and form a plate package with first plate interspaces for a first medium and second plate interspaces for a second medium. Each of the heat exchanger plates has four portholes which form ports extending through the plate package. The heat exchanger plates comprises an outermost heat exchanger plate at one side of the plate package and an outermost heat exchanger plate at an opposite side of the plate package. Two of the plate interspaces in the plate package form a respective outermost plate interspace at a respective side of the plate package, which are delimited outwardly by a respective one of the outermost heat exchanger plates. The strengthening plate is provided beside and outside one of the outermost heat exchanger plates.

SUMMARY OF THE INVENTION

The object of the present invention is to remedy the disadvantages mentioned above and to provide a plate heat exchanger with a high strength. Furthermore, it is aimed at a plate heat exchanger that can be manufactured at low costs. In particular, it is aimed at a permanently joined plate heat exchanger with a high strength.

This object is achieved by the plate heat exchanger initially defined, which is characterized in that the strengthening plate has a main zone, which extends in parallel with the extension plane and comprises a strengthening pattern, which is provided in the proximity of the two ports and comprises at least one depression extending outwardly from the plate package, wherein said depression is elongated along the extension plane and seen in a normal direction to the extension plane. One such strengthening plate with a strengthening pattern may be made thinner than a completely plane plate and at the same time resist the forces acting on the plate package. In particular, such a strengthening pattern may counteract the force which, due to a high pressure of any of the media, tends to deform the heat exchanger plates outwardly. Advantageously, the depression extends in a plane which is perpendicular to this force tending to deform the heat exchanger plates outwardly. The depression or the depressions may be obtained in connection with the compression-moulding of the strengthening plate. The depression is longer than wide and may obtain a significant length in said plane being perpendicular to this force tending to deform the heat exchanger plates outwardly.

According to an embodiment of the invention, the plate heat exchanger are permanently joined to each other. Preferably, the plates are permanently joined to each other through melting of a metallic material, such as through brazing and/or welding. It is to be noted that the plates also may be glued to each other. It is also to be noted that the invention also is applicable to plate heat exchangers provided with gaskets, where the heat exchanger plates are compressed against each other by means of suitable tie members, such as tie bolts.

According to a further embodiment of the invention, the strengthening pattern is design to coact with a press pattern of the outermost heat exchanger plate which is provided beside the strengthening plate in such a way that the strengthening plate is positioned in a defined position in relation to the outermost heat exchanger plate. In such a way the manufacturing of the plate heat exchanger is facilitated since the strengthening plate does not have to be attached to the outermost heat exchanger plate, for instance through welding, before the brazing of the plate heat exchanger. Thanks to the defined position, the strengthening plate may be locked in the desired position in relation to the outermost heat exchanger plate and the plate package.

According to a further embodiment of the invention, the depression has a substantially straight extension. This straight extension may, as indicated above, extend in parallel with a plane being perpendicular to the force tending to deform the heat exchanger plates. This plane is perpendicular, or substantially perpendicular, to the extension plane.

According to a further embodiment of the invention, the depression extends between said two ports. Especially between the ports, forces, which act outwardly from the plate package in a normal direction with respect to the extension plane, appear. Depressions in this area may in an efficient manner counteract such forces.

According to a further embodiment of the invention, the strengthening pattern comprises several depressions which extend outwardly from the heat exchanger plates. Advantageously, at least one of the depressions has a substantially straight extension. All or several of the depressions may advantageously be substantially straight and extend substantially in parallel to each other. Furthermore, at least one of the depressions may extend between said two ports.

According to a further embodiment of the invention, the main zone has a substantially plane extension, wherein the strengthening pattern extends outwardly from the plane extension.

According to a further embodiment of the invention, the main zone has an area which forms at least a larger part of the area of the strengthening plate. The area of the strengthening plate may be somewhat less than the area of the heat exchanger plates.

According to a further embodiment of the invention, the strengthening plate comprises at least two portholes, which are concentric to a respective port of said two ports. Consequently, the portholes of the strengthening plate may form a part of the ports of the plate heat exchanger. It is also to be noted that the strengthening plate may be continuous, i.e. comprising no portholes since the inlet and/or the outlet for the ports in question may be located on the side of the plate package which faces away from the strengthening plate.

According to a further embodiment of the invention, the strengthening plate comprises two strengthening patterns, which are provided in the proximity of a respective pair of ports and which each comprises at least one depression extending outwardly from the heat exchanger plates. The strengthening plate may then comprise at least four portholes, which are concentric to a respective port of the ports of the plate package.

According to a further embodiment of the invention, each heat exchanger plates comprises a heat exchanger zone and an outer edge zone, which extends around the heat exchanger zone, wherein the strengthening plate has such a size that it is contained within the outer edge zone. The outer edge zone may comprise a surrounding flange which extends outwardly from the extension plane. According to this embodiment the area of the strengthening plate is thus less than the area of the heat exchanger plates, and the strengthening plate may then advantageously be substantially plane in the sense that it does not comprise any flange as comprised by the heat exchanger plates. However, it is to be noted that the strengthening plate may in principle have the same area as the heat exchanger plates and be provided with a surrounding flange in the same way as the heat exchanger plates.

According to a further embodiment of the invention, the plates comprise a further strengthening plate which is provided outside the second of the outermost heat exchanger plates, wherein the further strengthening plate has a main zone, which extends in parallel with the extension plane and comprises a strengthening pattern, which is provided in the proximity of two of the ports and comprises at least one depression extending outwardly from the heat exchanger plates. Consequently, the plate package may on both sides comprise a strengthening plate for strengthening of the zone around the ports. The further strengthening plate may in principle have the same design as the above described strengthening plate.

BRIEF DESCRIPTION OF THE DRAWINGS

The present invention is now to be explained more closely by means of a description of various embodiments and with reference to drawings attached hereto.

DETAILED DESCRIPTION OF VARIOUS EMBODIMENTS OF THE INVENTION

Figure 1:
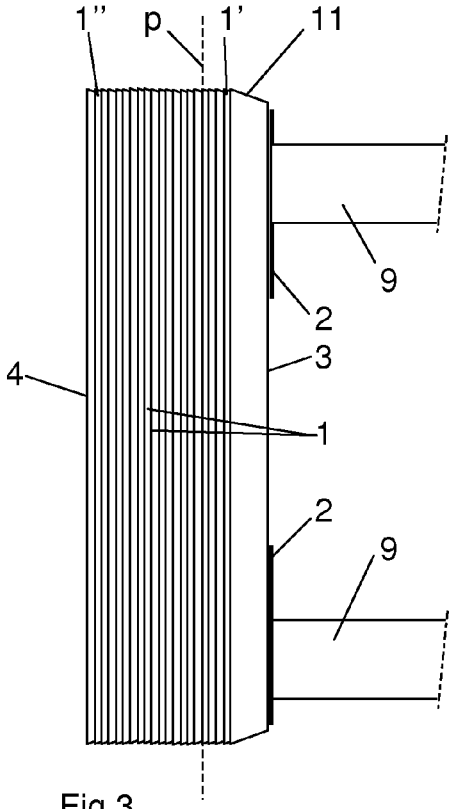
FIG. 1 discloses a side view of a plate heat exchanger according to a first embodiment of the invention.
Figure 2:
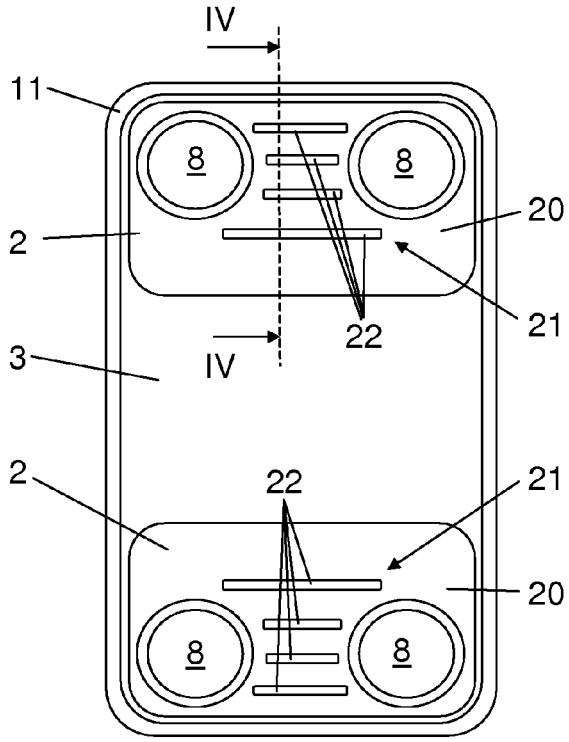
FIG. 2 discloses a front view of the plate heat exchanger in FIG. 1.
Figure 3:
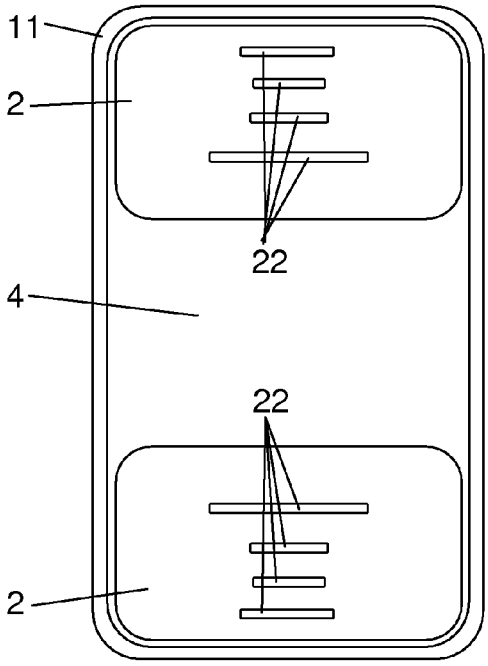
FIG. 3 discloses a front view of the plate heat exchanger in FIG. 1.

FIGS. 1-4 disclose a first embodiment of a plate heat exchanger according to the invention. The plate heat exchanger comprises a plurality of plates, which each extends substantially in parallel with a main extension plane p. The plates comprises in the first embodiment a plurality of heat exchanger plates 1 and at least one strengthening plate 2. In the first embodiment, the plate heat exchanger comprises four strengthening plates 2. In addition, the plates comprises a frame plate 3 and a pressure plate 4, which are provided on a respective side of the heat exchanger plates 1. The heat exchanger plates 1 form a plate package with first plate interspaces 5 for a first medium and second interspaces 6 for a second medium. The plate interspaces 5, 6 are provided in an alternating order in such a way that every second plate interspace is a first plate interspace 5 and the remaining plate interspaces are second plate interspaces 6, see FIG. 4.

Figure 5:
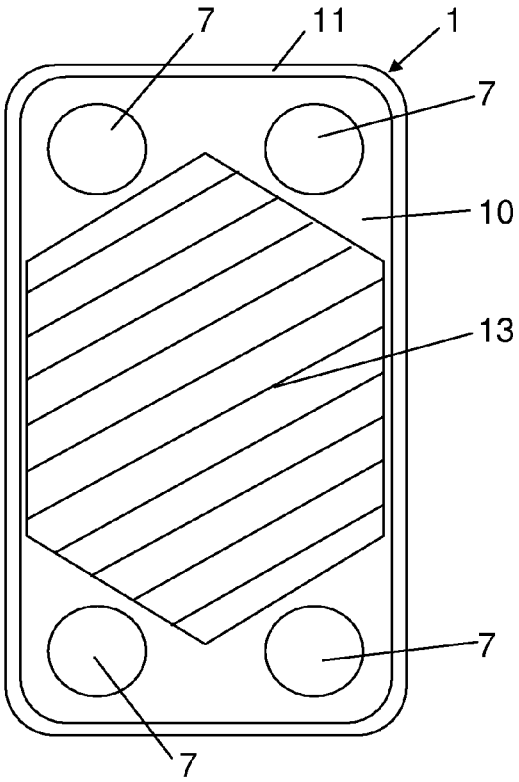
FIG. 5 discloses a front view of a heat exchanger plate of the plate heat exchanger in FIG. 1.

Each heat exchanger plate 1, see FIG. 5, comprises four portholes 7 which form ports 8 extending through the plate package and forming inlets and outlets for the two media to the first plate interspaces 5 and the second plate interspaces 6, respectively. The inlets and the outlets are connected to schematically disclosed inlet and outlet pipes 9. Each heat exchanger plate 1 comprises an inner heat exchanger zone 10 and an outer edge zone 11 extending around the heat exchanger zone 10. The outer edge zone 11 comprises or forms a surrounding flange extending outwardly from the extension plane p. Also the frame plate 3 and the pressure plate 4 have such an outer edge zone 11 which comprises or forms a flange extending outwardly from the extension plane p. In the first embodiment, each strengthening plate 2 has such a size that they are contained within the outer edge zone 11.

Furthermore, each heat exchanger plate 1 has in a manner known per se a press pattern 13, see FIG. 5, in the form of at least one corrugation of ridges and valleys on the heat exchanger zone 10. The press pattern 13 which is disclosed in FIG. 5 is merely schematic and one example of such a pattern. It is to be noted that the heat exchanger plates 1 may have press patterns of a variety of designs.

The heat exchanger plates 1 comprise an outermost heat exchanger plate 1' at a one side of the plate package and an outermost heat exchanger plate 1" at an opposite side of the plate package. Furthermore, the heat exchanger plates 1, 1', 1" form two outermost plate interspaces (reference sign 6 in FIG. 4) at a respective side of the plate package. The two outermost plate interspaces are delimited outwardly by the outermost heat exchanger plate 1' and the outermost heat exchanger plate 1", respectively. The strengthening plates 2 are provided outside one of the outermost heat exchanger plates 1' and 1", respectively.

In the first embodiment, the frame plate 3 is provided immediately outside the outermost heat exchanger plate 1' and the pressure plate 4 is provided immediately outside the outermost heat exchanger plate 1". The frame plate 3 and the pressure plate 3 have in the first embodiment no thermal function, i.e. non of the media is conveyed between the outermost heat exchanger plate 1' and the frame plate 3, or between the outermost heat exchanger plate 1" and the pressure plate 4. The frame plate 3 and the pressure plate 4 may thus be substantially plane, i.e. lack the press pattern 13 which is provided on the heat exchanger plates 1.

All the plates, i.e. the strengthening plates 2, the frame plate 3, the heat exchanger plates 1, 1', 1" and the pressure plate 4, are permanently connected to each other, preferably through melting of a metallic material, such as brazing, welding or a combination of brazing and welding. Also the inlet and the outlet pipes 9 may be brazed to the plates, and more precisely to the strengthening plates 2. The plates may also be permanently connected to each other through gluing. It is to be noted that the plates also may be connected to each other by means of a releasable connection, wherein the plates may be compressed to each other by means of tie bolts.

Figure 4:
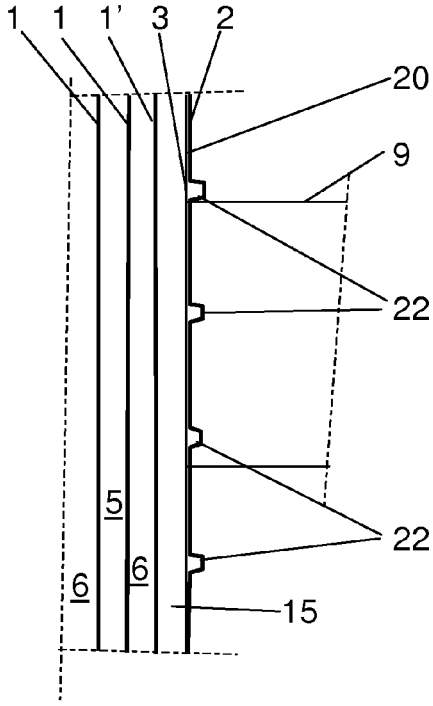
FIG. 4 discloses a section along the line IV-IV in FIG. 2.

In the first embodiment, the strengthening plates 2 are provided immediately outside the frame plates 3 and immediately outside the pressure plate 4, respectively. Each strengthening plate 2 has a main zone 20 which extends in parallel with the extension plane p. The main zone 20 comprises a strengthening pattern 21, which is provided in the proximity of two of the ports 8 and comprises at least one, in the first embodiment four elongated depressions 22 which extend outwardly from the plate package, see FIG. 4 which schematically shows the cross sectional shape of the depressions 22. In reality the cross sectional shape may be more smooth and for instance be close to a semi-circular shape. The strengthening pattern 21 may advantageously be obtained in connection with the compression-moulding of the strengthening plates 2. The strengthening plates 2, which are provided beside the frame plate 3, comprise two portholes which are concentric to a respective port 8. The strengthening plates 2, which are provided beside the pressure plate 4, see FIG. 4, are continuous, i.e. comprises no portholes.

It is to be noted that the depressions does not necessarily need to be elongated but may have a substantially circular or square shape seen in the normal direction of the extension plane p. It is essential that the depressions 22 have a certain extension in a plane being perpendicular to this force which tends to deform the heat exchanger plates 1, 1', 1" outwardly. The depressions 22 have in the first embodiment an elongated, substantially straight extension, with a substantially larger length than width seen in the above mentioned normal direction. Furthermore, the elongated depressions 22 extend substantially in parallel to each other. At least three of the elongated depressions 22 extend between two of the ports 8 in the first embodiment. It is to be noted that one or several of the elongated depression 22 may have an extension which deviates from the disclosed straight shape. For instance one or several of the elongated depressions 22 may be smoothly curved or angled in two or several sections.

During operation, a pressure arises in the interior of the plate heat exchanger, which pressure tends to press the plate package outwardly, in particular the outer heat exchanger plates 1, 1', 1". By means of the elongated depression 22 such a outward bending is prevented or reduced since the elongated depressions 22 extend along a plane which is perpendicular to, is substantially perpendicular to or extends at a relatively large angle to the outward bending that the inner force tends to provide.

The strengthening pattern 21 may also advantageously be designed to coact with a protrusion and/or depression of a press pattern of the plate which is provided most closely to the strengthening plate 2, i.e. in the first embodiment the frame plate 3 and the pressure plate 4. Thanks to such a cooperation, the strengthening plate 2 may be positioned in a defined position in relation to said most closely provided plate in connection with the manufacturing of the plate heat exchanger. In such a way, it is not necessary to attach the strengthening plates, for instance through spot welding to said most closely provided plate in advance, for instance before the plate heat exchanger is brazed.

Figure 6:
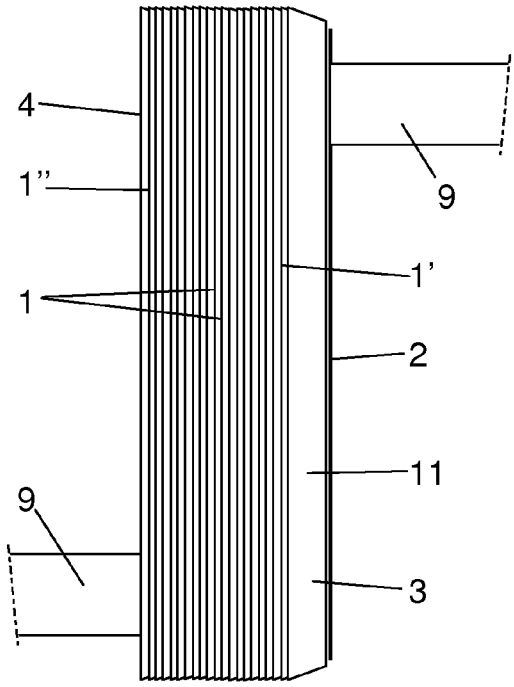
FIG. 6 discloses a side view of a plate heat exchanger according to a second embodiment of the invention.
Figure 7:
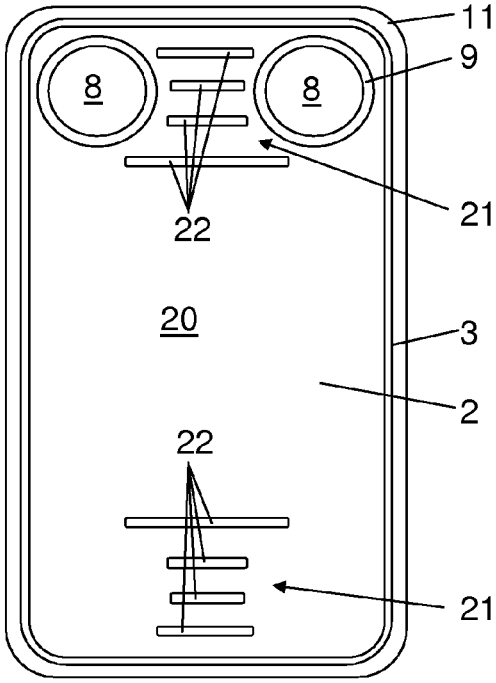
FIG. 7 discloses a front view of the plate heat exchanger in FIG. 6.
Figure 8:
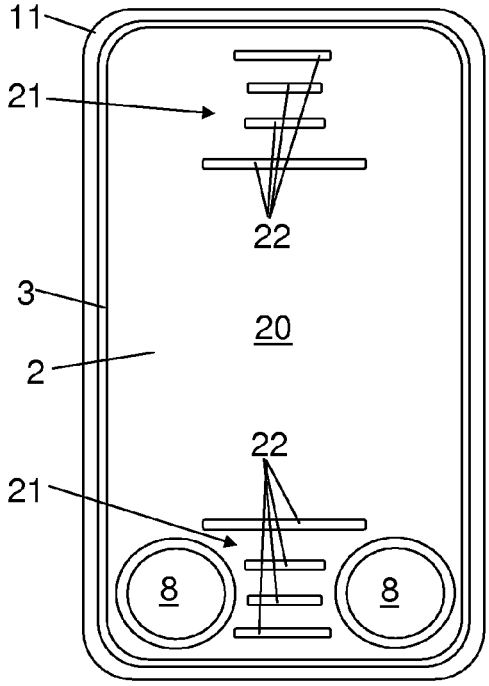
FIG. 8 discloses a front view of the plate heat exchanger in FIG. 6.

FIGS. 6-8 disclose a second embodiment which differs from the first embodiment in that it comprises two strengthening plates 2 instead of four strengthening plates 2. It is to be noted that in all embodiments, elements having substantially the same function are designated with the same reference signs. The strengthening plates 2 in the second embodiment are larger than in the first embodiment and extend over a zone including all four ports 8. Furthermore, in the second embodiment two of the inlet and outlet pipes 9 extend from one side of the plate heat exchanger and two of the inlet and outlet pipes 9 from the other opposite side of the plate heat exchanger. The strengthening plate 2, which is provided beside the frame plate 3, comprises four portholes which are concentric to a respective port 8. The strengthening plate 2, which is provided beside the pressure plate 4, see FIG. 8 is continuous, i.e. comprises no portholes.

Figure 9:
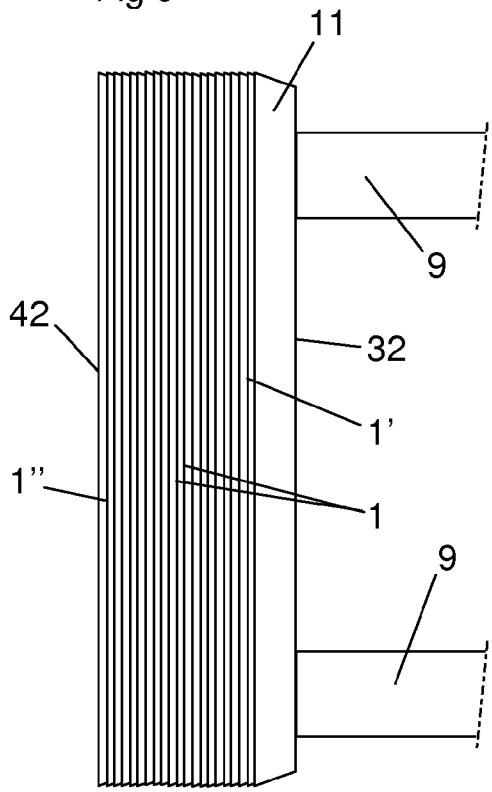
FIG. 9 discloses a side view of a plate heat exchanger according to a third embodiment of the invention.
Figure 10:
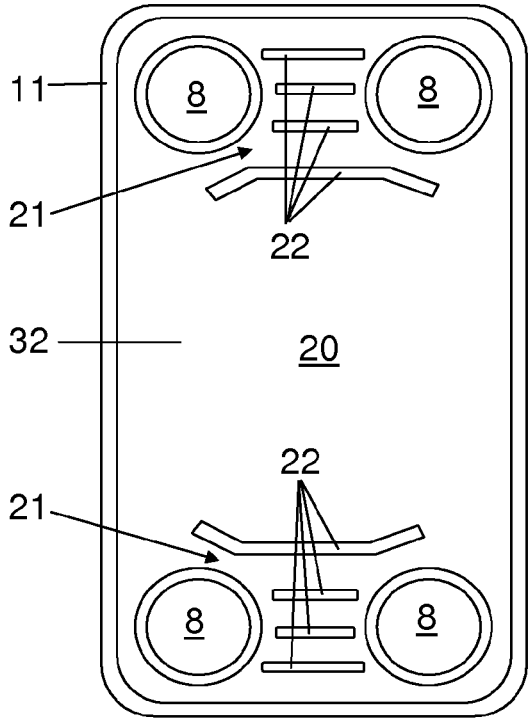
FIG. 10 discloses a front view of the plate heat exchanger in FIG. 9.
Figure 11:
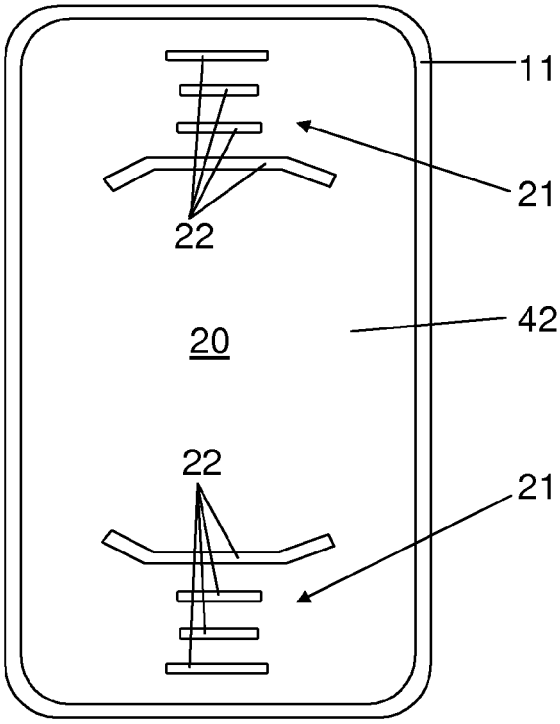
FIG. 11 discloses a front view of the plate heat exchanger in FIG. 9.

FIGS. 9-11 disclose a third embodiment which differs from the first and second embodiments in that it comprises a strengthening plate 32 which also forms a frame plate on one side of the plate package and a strengthening 42 which also forms a pressure plate on the other opposite side of the plate package. The strengthening plates 32, 42 in the third embodiment are somewhat larger than in the second embodiment and comprises also a respective edge zone 11 forming a flange extending outwardly from the extension plane. The strengthening plates 32 comprise four portholes which are concentric to a respective port, whereas the strengthening plate 42, see FIG. 11 is continuous, i.e. comprises no portholes. Furthermore, one of the elongated depressions 22 of each strengthening pattern 21 has in the third embodiment received an alternative design with somewhat angled end sections.

The invention is not limited to the above described embodiments but may be varied and modified within the scope of the following claims.

The invention claimed is:

1. A plate heat exchanger comprising a plurality of heat exchanger plates, each of which extends in parallel with a main extension plane, and at least one strengthening plate, wherein the heat exchanger plates are provided beside each other and form a plate package with first plate interspaces for a first medium and second plate interspaces for a second medium, wherein each of the heat exchanger plates has four portholes which form ports extending through the plate package, wherein the heat exchanger plates include an outermost heat exchanger plate at one side of the plate package and an outermost heat exchanger plate at an opposite side of the plate package, wherein two of the plate interspaces in the plate package form a respective outermost plate interspace at a respective side of the plate package, which are delimited outwardly by a respective one of the outermost heat exchanger plates, wherein the strengthening plate is provided outside one of the outermost heat exchanger plates, wherein the strengthening plate has a main zone, which extends in parallel with the extension plane and comprises a strengthening pattern, the strengthening pattern being provided in the proximity of two of the ports and comprising several depressions extending outwardly from the plate package, wherein at least one of the depressions is elongated along the extension plane and seen in a normal direction to the extension plane.

2. A plate heat exchanger according to claim 1, wherein the plates are permanently joined to each other.

3. A plate heat exchanger according to claim 2, wherein the plates are permanently joined to each other through melting of metallic material.

4. A plate heat exchanger according to claim 1, wherein the strengthening pattern is designed to coact with a press pattern of the outermost heat exchanger plate which is provided beside the strengthening plate in such a way that the strengthening plate is positioned in a defined position in relation to the outermost heat exchanger plate.

5. A plate heat exchanger according to claim 1, wherein at least one of the depressions has a substantially straight extension.

6. A plate heat exchanger according to claim 1, wherein at least one of the depressions extends between the two ports.

7. A plate heat exchanger according to claim 1, wherein the main zone has a substantially plane extension, wherein the strengthening pattern extends outwardly from the plane extension.

8. A plate heat exchanger according to claim 1, wherein the main zone has an area which forms at least a larger part of the area of the strengthening plate.

9. A plate heat exchanger according to claim 1, wherein the strengthening plate comprises at least two portholes, which are concentric to a respective port of the two ports.

10. A plate heat exchanger according to claim 1, wherein the strengthening plate comprises two strengthening patterns, which are provided in the proximity of a respective pair of ports and each of which comprises at least one depression extending outwardly from the heat exchanger plates.

11. A plate heat exchanger according to claim 10, wherein the strengthening plate comprises at least four portholes, each of which is concentric to a respective port of the ports of the plate package.

12. A plate heat exchanger according to claim 1, wherein each heat exchanger plate comprises a heat exchanger zone and an outer edge zone, which extends around the heat exchanger zone, wherein the strengthening plate has such a size that it is housed within the outer edge zone.

13. A plate heat exchanger according to claim 12, wherein the outer edge zone comprises a surrounding flange which extends outwardly from the extension plane.

14. A plate heat exchanger according to claim 1, wherein the plates comprise a further strengthening plate which is provided outside the second of the outermost heat exchanger plates, wherein the further strengthening plate has a main zone, which extends in parallel with the extension plane and comprises a strengthening pattern, which is provided in the proximity of two of the ports and comprises at least one depression extending outwardly from the heat exchanger plates.

* * * * *